US006358370B1

(12) United States Patent
Huttunen

(10) Patent No.: US 6,358,370 B1
(45) Date of Patent: Mar. 19, 2002

(54) SEALING ARRANGEMENT FOR A SUCTION BOX OF A SUCTION ROLL

(75) Inventor: Hannu Huttunen, Laakajärvi (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/711,792

(22) Filed: Nov. 13, 2000

(30) Foreign Application Priority Data

Nov. 12, 1999 (FI) ..... 992436

(51) Int. Cl.[7] ..... D21F 3/10

(52) U.S. Cl. ..... 162/363; 162/367; 162/368; 162/369; 162/371

(58) Field of Search ..... 162/217, 252, 162/272, 278, 297, 306, 308, 310, 335, 351, 357, 363, 364, 365, 366, 367, 368, 369, 370, 371, 372, 373, 374; 277/300

(56) References Cited

U.S. PATENT DOCUMENTS 1,694,698 A * 12/1928 Berry ..... 162/273
2,312,519 A * 3/1943 Berry ..... 162/371
2,418,600 A * 4/1947 Ostertag et al. ..... 162/214
3,027,940 A * 4/1962 Dunlap ..... 162/352
5,387,320 A * 2/1995 Jaakkola ..... 162/301
5,580,424 A 12/1996 Snellman ..... 162/371
5,997,694 A * 12/1999 Schiel et al. ..... 162/358.3

FOREIGN PATENT DOCUMENTS

WO 9920832 4/1999 ..... D21F/3/10
WO 9951812 10/1999 ..... D21F/3/10

* cited by examiner

*Primary Examiner*—Peter Chin
*Assistant Examiner*—Eric Hug
(74) *Attorney, Agent, or Firm*—Steinberg & Raskin, P.C.

(57) ABSTRACT

A suction box comprises a fixed frame part (11) and a lid part (12) disposed in the frame part (11) to be movable. The moving lid part (12) moves relative to the fixed frame part (11) with the aid of gravity or with the aid of expansion members (15*a*, 15*b*, 15*c*) positioned in link points between said two parts (11, 12). On the moving lid part (12), sealings (13*a*, 13*b*, 13*c*) are fitted, wherewith the suction box is sealed against the inner face of a shell (14) of a suction roll. In the link points between the fixed frame part (11) and the moving lid part (12), locking means (20) are disposed, wherewith the moving lid part (12) can be locked relative to the fixed frame part (11) in a desired position.

8 Claims, 3 Drawing Sheets

SEALING ARRANGEMENT FOR A SUCTION BOX OF A SUCTION ROLL

FIELD OF THE INVENTION

The present invention relates to a sealing arrangement for a suction box of a suction roll comprising a fixed frame part and a lid part movably disposed in the fixed frame part, moving relative to the fixed frame part with the aid of gravity or with the aid of expansion members disposed in the link points between said two parts, whereby sealings are arranged in the moving lid part, with which the suction box is sealed against the inner face of the shell of the suction roll.

BACKGROUND OF THE INVENTION

In paper and board machines, suction rolls are used in a number of different positions, said rolls being provided with one or more suction boxes. The suction boxes are in such cases sealed against the inner face of the shell of the suction roll with the aid of axial sealings. Said sealings are in general loaded with expansion members against the inner face of the shell of the suction roll, whereby the force directed at the sealings of the expansion members exerts an influence on the wear of the sealings.

A great number of diverse designs are available in the state of art, wherewith endeavors are made to reduce the wear of the suction box sealings. Some said state-of-the-art designs are described below.

In Finnish Patent application No. FI 980759, a sealing structure for the suction box of a suction roll is disclosed. The suction roll comprises a suction box and an elongated capsule-resembling holder part moving in radial direction to the suction roll. The holder part is provided, at a space from each other, with axial sealings disposed in the grooves of the holder part to seal against the inner face of the shell. Between the sealings a suction sector is formed, wherefrom a connection is provided through the holder part to the suction box. The holder part is at both ends fastened on the stationary shaft of the roll with screw means through the aid of which the distance of the holder part can be regulated off from the inner face of the roll shell. With a structure like this, the holder part is prevented from bending along with the shaft of the roll, whereby the axial sealings in the grooves of the holder part, extending across the longitudinal direction of the roll, are at all times kept at a constant distance from the inner face of the shell of the roll. Between the holder part and the suction box, also an actuator such as a piston-cylinder construction can be used, approximately in the middle part of the axial direction of the roll, with which, pushing or traction loading can be directed at the middle part of the holder for bending the holder part into a desired arc.

In Finnish Patent application No. FI 974023, a second sealing structure for the suction box of a suction roll is disclosed. The suction structure comprises a U-shaped holder and a sealing disposed therein, and at least one holder for a loading hose between the bottom wall and the sealing. With a pressure medium conducted into the loading hose, the sealing in the holder can be pressed against the inner face of the suction roll. One side face of the sealing is provided with a cavity with a slanted upper and lower wall, into which a second loading hose is arranged.

Between the loading hose and the side wall of the holder, a piston part is mounted, being equally provided with slanted upper and lower faces. On the opposite side face of the sealing, a second cavity is placed, provided with a slanted upper and lower wall, and with a double section in the bottom part, so that an elongated sealing strip is fitted in both sections of the cavity. A lath is mounted between the sealing strips and a side wall of the holder, being in equal manner provided with slanted upper and lower faces. When pressure medium is conducted into the second loading hose, the sealing is locked onto the side walls of the holder by means of the piston part and the lath. With the first loading hose, the sealing is taken onto the inner face of the roll shell, and with the second loading hose, the sealing is locked onto the side walls of the holder. Owing to the slanted upper and lower walls of the cavities and the likewise slanted upper and lower faces of the piston part and the lath, the sealing moves slightly aside and off from the inner face of the shell of the roll, while the sealing is locked with the second loading hose onto the side faces of the holder.

In Finnish Patent application No. 934909, a third sealing structure for the suction box of a suction roll is disclosed. The sealing structure comprises a holder, being substantially of U-shape and divided into two parts with a third short claw in the middle of the letter U. A sealing is provided in the holder, in the groove in the bottom of which a third claw is disposed. On both sides of the short claw in the middle of the holder bottom, loading hoses are arranged, with the aid of which the sealing can be loaded against the inner face of the shell of the roll. On one side wall of the holder, a cavity is located, on the bottom whereof being provided a third loading hose. Between the third loading hose and the sealing, a locking piston is arranged, with the aid of which the sealing can be locked to the holder. Also on the opposite side wall of the holder, a second locking piston can be provided, so that the sealing is locked with a loading hose between the opposite pistons. The upper faces of the cavities in the side walls of the holder can be slanted similar to the upper faces of the locking pistons, whereby the locking of the sealing to the holder simultaneously releases the sealing off from the inner face of the roll.

OBJECTS AND SUMMARY OF THE INVENTION

The invention can be applied in connection with such suction rolls in which the suction box is formed from a fixed frame part and a moving lid part disposed in the fixed frame part. The moving lid part is provided with holders, whereto axial sealings are attached, to seal against the inner face of the shell of the suction roll and to limit one or several suction sectors. The movement between the fixed frame part and the moving lid part of the suction box is in general achieved in arrangements such as this using expansion members disposed in the link points between the fixed frame part and the moving lid part. By conducting a pressure medium into the expansion members, the space of the moving lid part from the fixed frame part of the suction box can be increased. The movement of the moving lid part is limited with locking nuts, wherewith the metal parts of the holders of the moving lid part are prevented from touching the inner face of the rotary shell of the suction roll in a situation in which the sealings fitted in the holders have worn out. The locking nuts limiting the movement of the moving lid part are adjusted when maintaining the roll.

In such arrangements, the moving lid part cannot be locked in intermediate positions, instead, the expansion members load the moving lid part constantly and therethrough, also the sealings therein against the inner face of the shell, whereby the sealings wear out rapidly and uncontrollably. The wear of the sealings is especially problematic in roll positions in which the lid structure is downwards. Thereby, the moving lid part presses the sealings with its gravity against the inner face of the shell constantly.

The objective of the invention is to solve the problem related to said rapid and uncontrolled wear of the sealings in suction boxes which are formed from a fixed frame part and a lid part movingly positioned in the fixed frame part.

With the arrangement of the present invention, a situation is created in which the moving lid part of a suction box can be locked in a desired spot at each moment, so that the wear of the sealings can be reduced essentially. With the expansion members placed between the link points of the fixed frame part and the moving lid part of the suction box, the axial sealings in the holders of the moving lid part are taken onto the inner face of the shell of the suction roll. Thereafter, the moving lid part is moved slightly towards the fixed frame part with the locking members at the same time as the locking members lock the moving lid part to the fixed frame part. Thus, a situation is created with the locking members, in which the sealings are about to touch the inner face of the shell of the suction roll. When the sealings later wear so that between the sealings and the inner face of the shell of the suction roll a gap is formed which is too wide, the locking can be released, whereafter the sealings are driven with the expansion members again to be attached to the inner face of the shell of the suction roll, whereafter the locking of the moving lid part is carried out again in a new spot.

The arrangement of the present invention functions equally well irrespective of the fact whether the suction roll is in a position in which the lid structure of the suction box is upwards or in a position in which the lid structure of the suction box is downwards. When the lid structure of the suction box is downwards, no expansion members are necessarily needed between the fixed frame part and the moving lid part of the suction box. In said position, the gravity moves the moving lid part downwards, whereby the sealings are pressed against the inner face of the shell of the suction roll.

The invention is described below in detail, reference being made to the embodiment examples of the invention depicted in the figures of the accompanying drawing, whereto the invention is not, however, intended to be exclusively restricted

DETAILED DESCRIPTION OF THE INVENTION

Figure 1:
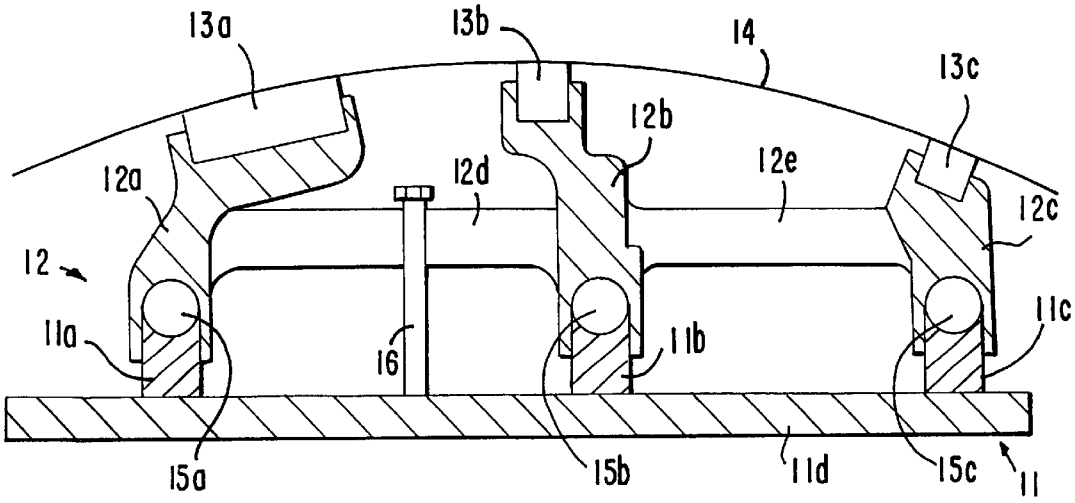
FIG. 1 is a schematic cross-section of a lid structure of a suction box of a suction roll provided with a fixed frame part and a moving lid part.

FIG. 1 presents the fixed frame part 11 of a suction box of a suction roll and a moving lid part 12 arranged therein to be movable. Of the fixed frame part, merely the portion concerning the lid structure is shown in the figure. The actual suction box beneath the lid structure is not shown in the figure. The frame part 11 is formed from a support structure 11*d*, from which three projections 11*a*, 11*b*, 11*c* project, being directed against an inner face of a shell 14 of the suction roll. The moving lid part 12 is formed from three holders 12*a*, 12*b*, 12*c* slidably disposed in the projections 11*a*, 11*b*, 11*c* of the fixed frame part 11, and from support parts 12*d*, 12*e* connecting same. Each holder 12*a*, 12*b*, 12*c* is provided with an axial sealing 13*a*, 13*b*, 13*c*, with which the space between the holders 12*a*, 12*b*, 12*c* is sealed against the inner face of the shell 14 of the roll. Between the projections 11*a*, 11*b*, 11*c* and the holders 12*a*, 12*b*, 12*c* arranged slidably therein are loading hoses 15*a*, 15*b*, 15*c*, into which a pressure medium can be directed and with the aid of which the moving lid part 12 can be moved in relation to the fixed lid part 11. The movement of the moving lid part 12 is limited by a locking nut/screw assembly 16 passing through the moving lid part 12 and secured to the fixed lid part 11, whereby the moving lid part 12 can be prevented from touching the rotary shell 14 of the suction roll by adjustment of the locking nut/screw assembly 16.

The embodiment in FIG. 1 comprises a suction box having two suction sectors. A first suction sector formed between the sealings 13*a* and 13*b* and a second suction sector formed between the sealings 13*b* and 13*c*. According to the present invention, a suction box can, in fact, be comprised of one suction sector only or of more than two suction sectors. The support structure 11*d* is formed as a separate part which is secured to the frame part of the suction box. Alternatively, the support structure 11*d* may also form a unitary portion of the frame part of the suction box.

Figure 2:
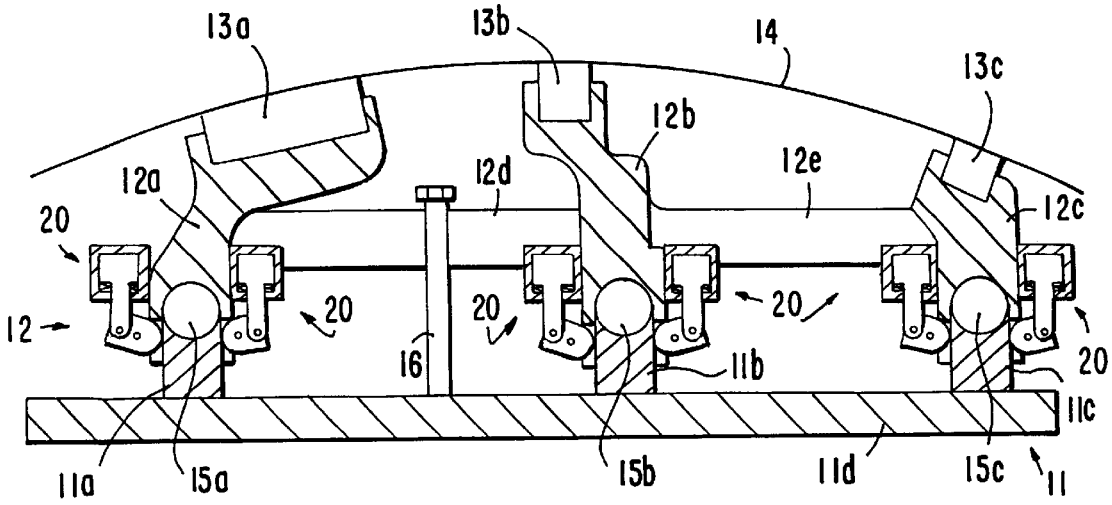
FIG. 2 is a schematic cross-section of the lid structure of FIG. 1 provided with a locking system of the sealings of the invention.

In FIG. 2, an arrangement of the invention is presented in which a pair of locking means 20 are used between each projection 11*a*, 11*b*, 11*c* of the fixed frame part 11 and the equivalent holder 12*a*, 12*b*, 12*c* of the moving lid part 12, with which the moving lid part 12 of the suction box of the suction roll can be locked relative to the fixed frame part 11 of the suction box of the suction roll.

Figure 3A:
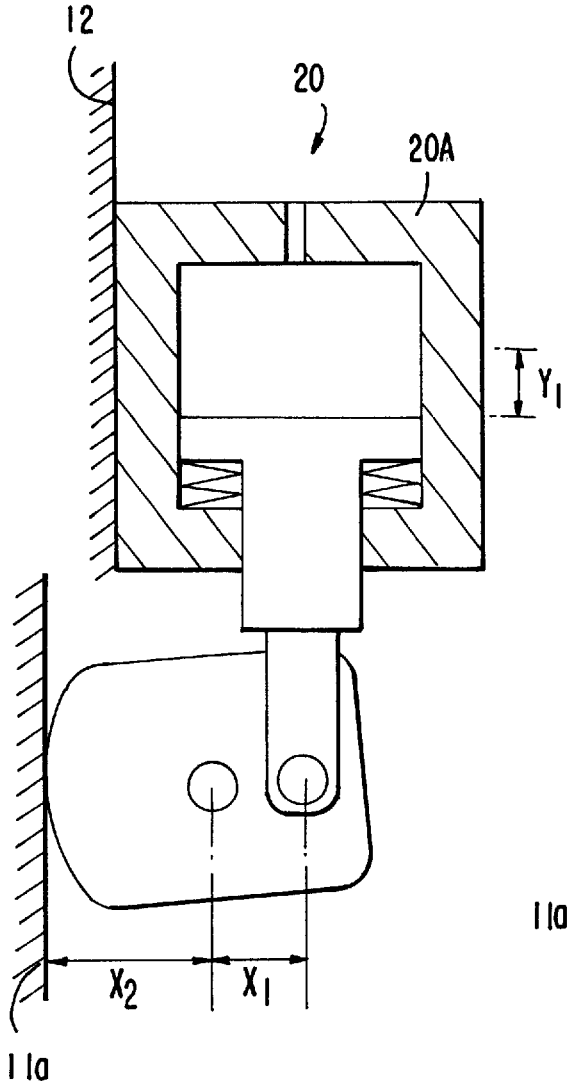
FIG. 3A is an enlarged elevational view of the locking means according to the present invention shown in locked position.
Figure 3B:
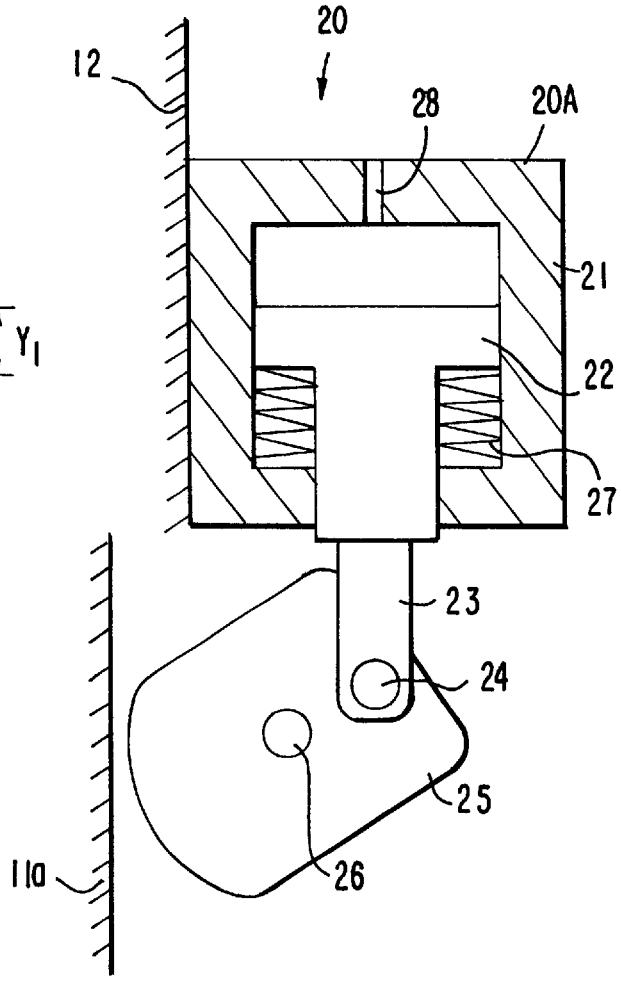
FIG. 3B is an enlarged elevational view of the locking means according to the present invention shown in open position.

The locking means 20 are shown in greater detail in FIGS. 3A and 3B, wherein, in FIG. 3A the locking means is shown in closed position and in FIG. 3B the locking means is shown in open position. The locking means comprises an actuator 20A secured to the moving lid part 12 and pivotally mounted to an eccentric means 25. The actuator comprises a cylinder 21 secured to the moving lib part 12, a piston 22 disposed within the cylinder 21 and a piston rod 23 fastened to the piston 22 and extending from the cylinder 21. The eccentric means 25 comprises a first link point 26 for pivotally securing a center of the eccentric means 25 to the moving lid part 12 and a second link point 24 for securing an outer end of the eccentric means 25 to the piston rod 23 of the actuator 20A. The moving lid part 12 may be secured to the moving lid part by for example providing a support bar (not shown) connect at a first portion secured to said moving lid part and having a second portion adapted for passing through said first link point 26 whereby the eccentric means 25 rotates about the first link point 26. The outer end of the eccentric means 25 is thereby pivotally supported by the piston rod 23 at the second link point 23 while an inner end of the eccentric means 25 is supported by a vertical side wall of a projection 11*a*, 11*b*, 11*c* of the fixed frame part 11. A spring 27 can be used for returning the piston 22 into the cylinder, against the spring force of which the piston 22 is moved by a pressure medium conducted on a top of the piston 22 from a pressure medium duct 28 into the cylinder 21.

The sealing structure of the suction box of the suction roll implementing the locking means according to the present invention, as seen in FIGS. 3A and 3B, functions so that the sealings 13*a*, 13*b*, 13*c* of the moving lid part 12 are first driven onto the inner face of the shell 14 of the suction roll by guiding pressure medium into the loading hoses 15*a*, 15*b*, 15*c*. Thereafter, a pressure medium is conducted into the cylinders 21 of the locking means 20, through the pressure medium duct 28, so that the pistons 22 and the rods 23 attached thereto push the outer end of the eccentric means 25 downwards and a curved inner end of the eccentric means 25 rotates upwards. In this manner, the moving lid part 12 moves towards the fixed frame part 11, whereby the sealings 13*a*, 13*b*, 13*c* of the moving lid part 12 are released from the inner face of the shell 14 of the suction roll to thereby form a small gap between the sealings 13*a*, 13*b*, 13*c* of the moving lid part 12 and the inner face of the shell 14 of the suction roll. The pistons 22 of the locking means 20 are thereafter kept in an outermost extended position by means of the pressure medium conducted into the cylinders 21 of the locking means 20, thereby keeping the moving lid part 12 in locked position. The magnitude of the swing achievable by the inner surface of the eccentric means 25 by using the locking means 20 can be determined by selecting, on the one hand, the length $y_1$ of the distance in which the piston 22 moves within the cylinder 21 and on the other hand, by selecting the ratio of the distance $x_1$ between the second support point 26 and the support point 24 of the piston rod 23 and the distance $x_2$ between the second support point 26 and the curved inner face of the eccentric means 25 appropriately.

Figure 4A:
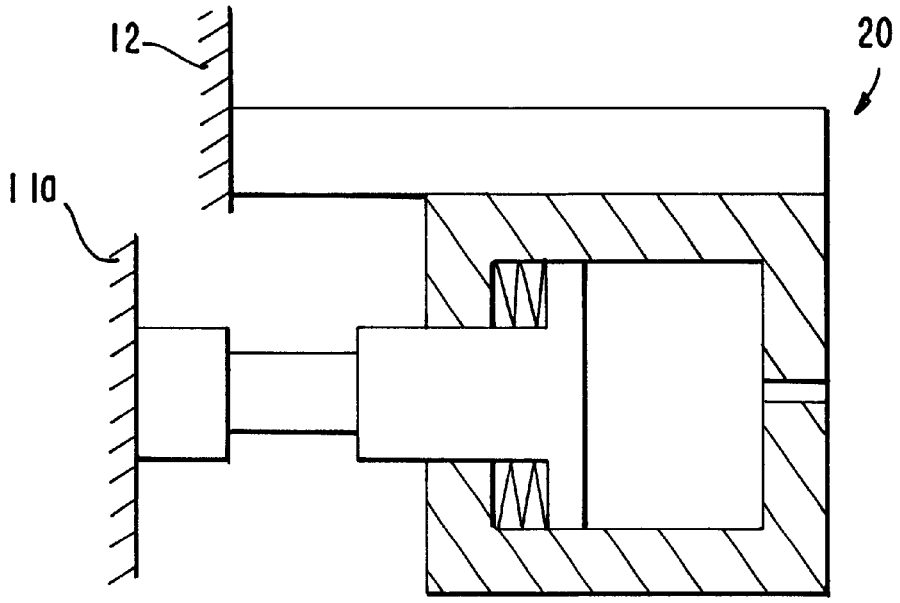
FIG. 4A is an enlarged elevational view of a second locking means according to the present invention, shown in closed position.
Figure 4B:
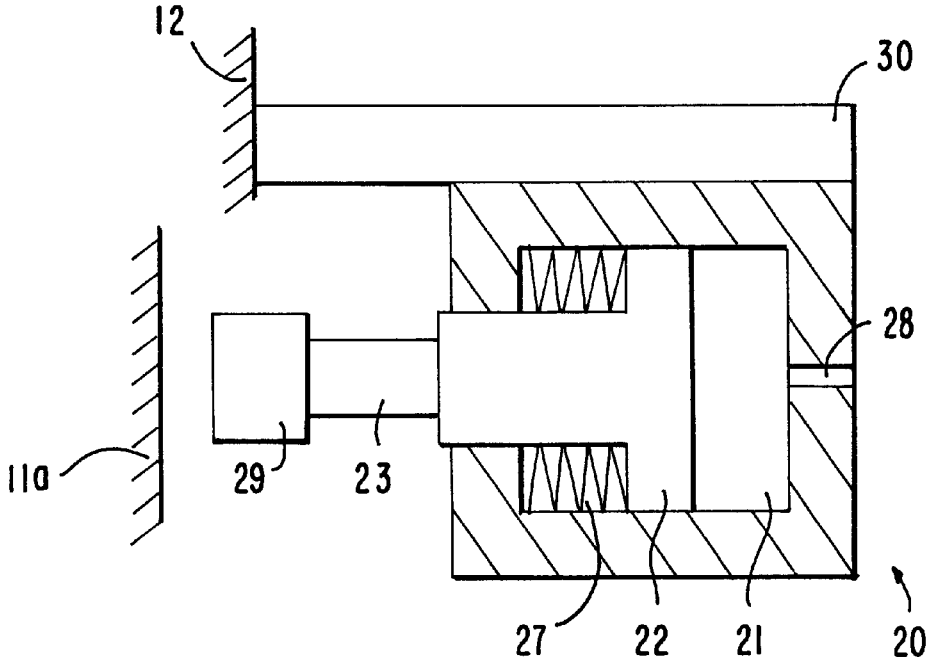
FIG. 4B is an enlarged elevational view of the second locking means according to the present invention, shown in open position.

FIGS. 4A and 4B represent another locking means 20 according to the present invention. FIG. 4B shows the locking means 20 in an open position and in FIG. 4A the locking means is shown in a closed position. Here, a similar cylinder-piston actuator is used as in FIGS. 3A and 3B, but here no eccentric means 25 is used. In the present embodiment the cylinder-piston actuator is located substantially in a horizontal position. The cylinder 21 is secured onto the moving lid part 12 by means of an intermediate support piece 30, and a gripping means 29 fastened on the end of the piston rod 23 carries out the locking against the fixed frame part 11. In addition, if so desired, the cylinders 21 can be fastened to the horizontal parts 12*d*, 12*e*interconnecting the holders 12*a*, 12*b*, 12*c* of the moving lid part 12.

The sealing structure of the suction box of the suction roll, according to the present invention, implementing the locking means as shown in FIGS. 4A and 4B functions so that first the sealings 13*a*, 13*b*, 13*c* of the moving lid part 12 are run onto the inner face of the shell 14 of the suction roll by conducting pressure medium into the loading hoses 15*a*, 15*b*, 15*c*. Thereafter, a pressure medium is conducted into the cylinders 21 of the locking means 20 through the pressure medium duct 28, so that the pistons 22 and the rods 23 mounted thereto push the gripping member 29 towards the fixed frame part 11. The moving lid part 12 is thus locked to the fixed frame part 11 in a position in which the sealings 13*a*, 13*b*, 13*c* of the moving lid part 12 are locked onto the inner face of the shell 14 of the suction roll. Since the sealings 13*a*, 13*b*, 13*c* are now pressed against the inner face of the shell 14 of the suction roll after the locking step, they first wear to some extent against the inner face of the shell 14, whereafter a small gap is formed between the sealings 13*a*, 13*b*, 13*c* and the inner face of the shell 14 of the suction roll.

For the actuator of the locking means 20, for instance, a hydraulic or pneumatic piston cylinder design 21, 22 can be used, or an electrically operating stepper motor can be used.

As seen in the figures, there are locking means 20 positioned on both sides of the projections 11*a*, 11*b*, 11*c* of the fixed frame part 11 in the machine direction and in the cross-machine direction, in practice, there are locking means 20 at least on both ends of the projections 11*a*, 11*b*, 11*c* (not shown). Thus, at least four locking means 20 are connected with each projection 11*a*, 11*b*, 11*c*.

When the locking means 20 are positioned in pairs on both sides of the projections 11*a*, 11*b*, 11*c* of the fixed frame part 11, the locking will be highly reliable in operation. It is, however, conceivable that the locking means 20 are positioned merely on one side of the projections 11*a*, 11*b*, 11*c* of the fixed frame part 11.

The invention is described above referring merely to the advantageous embodiment examples thereof, to the details of which the invention is not, however, intended to be exclusively restricted. A number of modifications and variations are conceivable within the scope of the inventive idea of the claims below. As such, the examples provided above are not meant to be exclusive and many other variations of the present invention would be obvious to those skilled in the art, and are contemplated to be within the scope of the appended claims.

I claim:

1. A sealing arrangement for a suction box of a suction roll, said suction box comprising:

a fixed frame part (11) and a lid part (12) movably disposed in the fixed frame part (11), moving relative to the fixed frame part (11) with the aid of gravity or with the aid of expansion members (15*a*, 15*b*, 15*c*) disposed in the link points between said fixed frame part and said lid part part (11, 12), whereby sealings (13*a*, 13*b*, 13*c*) are arranged in the moving lid part (12), with which the suction box is sealed against the inner face of the shell (14) of the suction roll, wherein locking means (20) are arranged in the link points between the fixed frame part (11) and the moving lid part (12), with which the moving lid part (12) can be locked in a desired position relative to the fixed frame part (11), wherein the locking means (20) comprises an actuator (21, 22, 23) fastened to the moving lid part (12), on the outer end of the moving part (22, 23) whereof a gripping member (29) is fastened, whereby a pushing movment of the moving part (22, 23) of the actuator pushes the gripping member (29) onto the fixed frame part (11), as a result of which the moving lid part (12) and the fixed frame part (11) are locked relative to each other.

2. The sealing arrangement according to claim 1, wherein the locking means (12) comprises:

an actuator (20A) fastened to the moving lid part (12) and an eccentric means (25) fastened on its middle part with a first link point (26) to the moving lid part (12), on the outer end whereof the moving part (23) of the actuator is fastened with a second link point (24) and the curved inner end whereof is supported to the fixed frame part (11) so that a small pushing movement of the moving part (23) of the actuator moves the eccentric means (25) around the first link point (26) so that the moving lid part (12) moves a small way towards the fixed frame part (11) and becomes locked to the fixed frame part (11).

3. The sealing arrangement according to claim 1, wherein the actuator comprises:

a cylinder (21) fastened to the moving lid part (12), a piston (22) disposed in the cylinder, a piston rod (23) fastened to the piston (22), which piston rod is fastened with a second link point (24) to the outer end of the eccentric means (25), whereby a small pushing movement of the piston rod (23) moves the eccentric means (25) around the link point (26) so that the moving lid part (12) moves a small way towards the fixed frame part (11) and becomes locked to the fixed frame part (11).

4. The sealing arrangement according to claim 1, wherein the actuator comprises:

a cylinder (21) fastened to the moving lid part (12), a piston (22) disposed in the cylinder, a piston rod (23) fastened to the piston (22) and a gripping member (29) fastened to the piston rod (23), whereby a pushing movement of the piston rod (23) pushes the gripping member (29) onto the fixed frame part (11), as a result of which the moving lid part (12) and the fixed frame part (11) are locked relative to each other.

5. A sealing arrangement for a suction box of a suction roll, said suction box comprising:

a fixed frame part (11);

a movable lid part (12) operatively connected to said fixed frame part (11); a plurality of link points interconnecting said fixed frame part (11) and said movable lid part (12);

expansion members (15*a*, 15*b*, 15*c*) disposed within said link points between said fixed frame part (11) and said movable lid part (12); said expansion members (15*a*, 15*b*, 15*c*) expandable to a first position in which said movable lid part (12) is forced into contact with an inner face of a shell of said suction roll and a second position in which said movable lid part (12) is spaced a distance from said inner surface; and a plurality of locking means (20) structured and arranged at each of said link points between said fixed frame part (11) and said moving lid part (12) whereby said moving lid part can be selectively locked into a position relative to said fixed frame part;

wherein said locking means (20) further comprises an actuator (20A) secured to said moving lid part (12) having:

a cylinder (21);

a piston (22) structured and arranged within said cylinder (21); and a piston rod (23) fastened to said piston (22) and having a gripping member (29) secured to an outer end thereof;

whereby a pushing movement on the piston (22) pushes the piston rod (23) and the gripping member (29) into abutment with said fixed frame part (11) thereby locking said moving lid part (12) relative to said fixed frame part (11).

6. A sealing arrangement for a suction box of a suction roll, wherein said suction box comprises:

a fixed frame part having a plurality of projections extending therefrom, each of said projections having a recess structured and arranged for receiving a pressure medium transmission member;

a movable lid part having a plurality of axial sealing members structured and arranged for contacting an inner surface of said suction roll and a plurality of depending support parts structured and arranged to be seated atop each of said projections of said fixed frame part; said movable lid part being movable between a first position in which said axial sealing members are spaced from said inner surface suction roll, when no pressure is transmitted into said pressure transmission medium, and a second position in which said axial sealing members contact said surface of said suction roll, when a pressure is transmitted into said pressure transmission medium; and a plurality of locking means fixedly secured to said movable lid part and having eccentric means pivotally attached to said locking means for locking said movable lib part relative to said fixed frame part;

wherein said actuator further comprises a cylinder secured to said movable lid part having:

an inner surface;

a pressure duct formed at a top surface of said cylinder; and a piston hole formed at a bottom surface of said cylinder;

a piston having:

a first end structured and arranged to slidably move within said cylinder and to sealingly contact said inner surface of said cylinder; and a second end structured and arranged to engage said piston hole of said cylinder;

a piston rod secured to said second end of said piston; and spring means structured and arranged between said first end of said piston and said bottom surface of said cylinder for biasing said piston toward said top surface of said cylinder.

7. The sealing arrangement according to claim 6, wherein said actuator further comprises:

a cylinder secured to said movable lid part having:

an inner surface;

a pressure duct formed at a top surface of said cylinder; and a piston hole formed at a bottom surface of said cylinder;

a piston having:

a first end structured and arranged to slidably move within said cylinder and to sealingly contact said inner surface of said cylinder; and a second end structured and arranged to engage said piston hole of said cylinder;

a piston rod secured to said second end of said piston; and spring means structured and arranged between said first end of said piston and said bottom surface of said cylinder for biasing said piston toward said top surface of said cylinder.

8. The sealing arrangement according to claim 6, wherein said locking means further comprises:

an eccentric means having a curved inner end structured and arranged to abut said fixed frame part and an outer end; said eccentric means being pivotally secured at a middle part thereof to said moving lid part at a first link point and pivotally secured at said outer end to said piston rod at a second link point, said eccentric means being pivotable from an open position in which said spring means bias said piston toward said top surface of said cylinder whereby said eccentric means is spaced from said fixed frame part to a closed position in which said spring means bias id overcome by a positive pressure acting on said piston through said pressure duct, whereby said piston rod is pushed out of said cylinder and thereby rotates said eccentric means about said first link point such that said curved inner end of said eccentric means abuts said fixed frame part and simultaneously locks said moving lid part relative to said fixed frame part.

* * * * *